US005473314A

United States Patent [19]

Mochizuki et al.

[11] Patent Number: 5,473,314

[45] Date of Patent: Dec. 5, 1995

[54] HIGH SENSITIVITY SMOKE DETECTING APPARATUS USING A PLURALITY OF SAMPLE GASES FOR CALIBRATION

[75] Inventors: Mikio Mochizuki; Hideo Ito; Ryousaku Kobayashi; Tadao Morita, all of Toyki, Japan

[73] Assignee: Nohmi Bosai, Ltd., Tokyo, Japan

[21] Appl. No.: 91,271

[22] Filed: Jul. 15, 1993

[30] Foreign Application Priority Data

Jul. 20, 1992 [JP] Japan ..... 4-214669
Nov. 6, 1992 [JP] Japan ..... 4-322686

[51] Int. Cl.[6] ..... G08B 17/10; G08B 29/00

[52] U.S. Cl. ..... 340/630; 340/515

[58] Field of Search ..... 340/514–516, 340/628–630, 556

[56] References Cited

U.S. PATENT DOCUMENTS

| | | | |
|---|---|---|---|
| 3,866,195 | 2/1975 | Ried, Jr. | 340/629 |
| 4,097,850 | 6/1978 | Conforti | 340/514 |
| 4,193,069 | 3/1980 | Cooper et al. | 340/630 |
| 4,317,113 | 2/1982 | Honma | 340/630 |
| 4,524,351 | 6/1985 | Kimura et al. | 340/629 |
| 4,595,914 | 6/1986 | Siegel | 340/515 |
| 5,212,470 | 5/1993 | Thuillard | 340/629 |
| 5,281,810 | 1/1994 | Fooks et al. | 340/556 |

FOREIGN PATENT DOCUMENTS

| | | | |
|---|---|---|---|
| 0054680 | 6/1982 | European Pat. Off. | G08B 17/10 |
| 2175392 | 11/1986 | United Kingdom | G08B 17/10 |
| 2188725 | 10/1987 | United Kingdom | G08B 17/10 |

*Primary Examiner*—James J. Groody
*Assistant Examiner*—John W. Miller
*Attorney, Agent, or Firm*—Wenderoth, Lind & Ponack

[57] ABSTRACT

A smoke detecting apparatus for a fire alarm has: a smoke chamber into which smoke to be detected is introduced, a light emitting lamp disposed in the smoke chamber, a light receiving element disposed in the smoke chamber so as to receive the light emitted from the light emitting lamp, an A/D converting circuit for converting the output signal from the light receiving element into a digital signal, a memory for storing data therein, a computing device for storing in said memory, as first calibration data, the output data from the A/D converting circuit when the smoke chamber is filled with a first reference gas, storing in said memory, as second calibration data, the-output data from the A/D converting circuit when the smoke chamber is filled with a second reference gas, and computing a proper smoke density corresponding to the output data from the A/D converting circuit on the basis of the first and second calibration data and the output data from the A/D converter circuit, and a display device for displaying the smoke density computed by the computing device.

11 Claims, 7 Drawing Sheets

PRIOR ART

PRIOR ART

HIGH SENSITIVITY SMOKE DETECTING APPARATUS USING A PLURALITY OF SAMPLE GASES FOR CALIBRATION

BACKGROUND OF THE INVENTION

1. Field of the Invention

The present invention relates to a high-sensitivity smoke detecting apparatus for a fire alarm in which a plurality of sample gases are introduced into a smoke chamber in order to calibrate the sensitivity characteristic.

2. Description of the Related Art

When the sensitivity characteristic of a smoke detector is calibrated by introducing a plurality of sample gases into a smoke chamber, two kinds of pure gases such as oxygen gas and freon 12 (F12: $CCl_2F_2$) gas, which have greatly different molecular weights, are generally alternately passed through the smoke chamber. The light emitted from a light emitting lamp is scattered by the molecules of the sample gases. The sensitivity characteristic, of the smoke sensor is calibrated by utilizing the phenomenon that the scattered light is captured by a light receiving element.

Namely, since the densities of the pure gases are stable, when a pure gas is introduced into the smoke chamber and is detected as smoke, a very low value of smoke density is output. In other words, the density of the pure gas corresponds to the output low value of smoke density. This can thus be employed for calibrating the sensitivity characteristic of a high-sensitivity smoke detector.

FIG. 7 shows the circuit of a principal portion of a conventional smoke detector.

In this conventional example, the light emitted from a xenon lamp (not shown) is scattered by smoke, and the scattered light is received by a light receiving element 81. The output signal from the light receiving element 81 is amplified by an amplifier 82, and the peak value thereof is held by a peak holding circuit 84. The data obtained by subtracting a predetermined value from the peak value using a subtraction circuit 85 is transmitted to a receiver through a signal output circuit 87. A gain adjusting variable resistor 83 adjusts the gain of the amplifier 82, and an offset adjusting variable resistor 86 adjusts the predetermined value subtracted from the peak value.

FIG. 8 shows the values of current I output from the signal output circuit 87 relative to the smoke density (gas density) when pure oxygen gas and freon 12 gas are alternately introduced into the smoke chamber. In FIG. 8, line C1 shows the characteristics when the sensitivity of the smoke detector is not adjusted, and line C3 shows the characteristics when the sensitivity has been adjusted. On the line C3 obtained by adjusting the gain adjusting variable resistor 83 and the offset adjusting variable resistor 86, the output currents of the signal output circuit 87 when oxygen gas is used and when freon 12 gas is used are denoted by I1 and I2, respectively.

Such adjustment of the sensitivity of the smoke detector is performed by regulating the slope of the line C1 and moving the line C1 in parallel. The output of the smoke detector is, in fact, adjusted while an ammeter or the like is observed. The freon 12 gas is first introduced into the smoke chamber, and the slope of the characteristic line C1 is adjusted by operating the gain adjusting variable resistor 83 so that the output I of the signal output circuit 87 may become I2 to obtain the characteristics shown by a line C21. The oxygen gas is then introduced, and the line C21 is moved parallel so that the output I of the signal output circuit 87 may become I1 by operating the offset adjusting variable resistor 86 to obtain a line C22. The freon 12 gas is again introduced, and the slope of the line C22 is adjusted by operating the gain adjusting variable resistor 83 so that the output I may become I2 to obtain a line C23. The above operation is repeated until the characteristic line C3 is obtained.

In the change from the characteristic line C1 to the characteristic line C3, when the offset adjusting variable resistor 86 is adjusted (parallel movement) so that the output data at the time of use of oxygen gas may become the value I1, the output value corresponding to the freon 12 gas deviates from the value I2, and thus the characteristic line C3 cannot be obtained. When the gain adjusting variable resistor 83 is then adjusted (adjustment of slope) so that the output data at the time of use of freon 12 gas may become the value I2, the output value corresponding to oxygen gas deviates from the value I1, and thus the characteristic line C3 cannot correctly be obtained. Therefore, the sensitivity adjustment cannot be completed by measuring the characteristics using oxygen gas and freon 12 gas only once.

Although the characteristics, of course, gradually approach the characteristic line C3 in the process of repeating the above measurements, several measurements of the characteristics are required. Since the gases used must be completely replaced by new gases at each measurement, the gas replacing work is difficult and troublesome. The above conventional smoke detecting apparatus thus has the problem that the work of adjusting the sensitivity of the smoke detector is troublesome and requires much time.

SUMMARY OF THE INVENTION

An object of the present invention is to provide a smoke detecting apparatus for fire alarm in which the work of adjusting the sensitivity of a smoke detector can be easily made and completed within a short time.

In order to achieve the object, a smoke detecting apparatus for fire alarm of the present invention comprises a smoke chamber into which smoke to be detected is introduced, a light emitting lamp disposed in the smoke chamber, a light receiving element disposed in the smoke chamber so as to receive the light emitted from the light emitting lamp, an A/D converting circuit for converting the output signal from the light emitting element into a digital signal, a memory for storing data therein, computing means for storing as first calibration data the output data from the A/D converting circuit in the memory when the smoke chamber is filled with a first reference gas, storing as second calibration data the output data from the A/D converting circuit in the memory when the smoke chamber is filled with a second reference gas, and calculating a proper smoke density corresponding to the output data from the A/D converting circuit on the basis of the first and second calibration data and the output data from the A/D converting circuit, and display means for displaying the smoke density calculated by the computing means.

DESCRIPTION OF THE PREFERRED EMBODIMENTS

Embodiment 1

Figure 1:
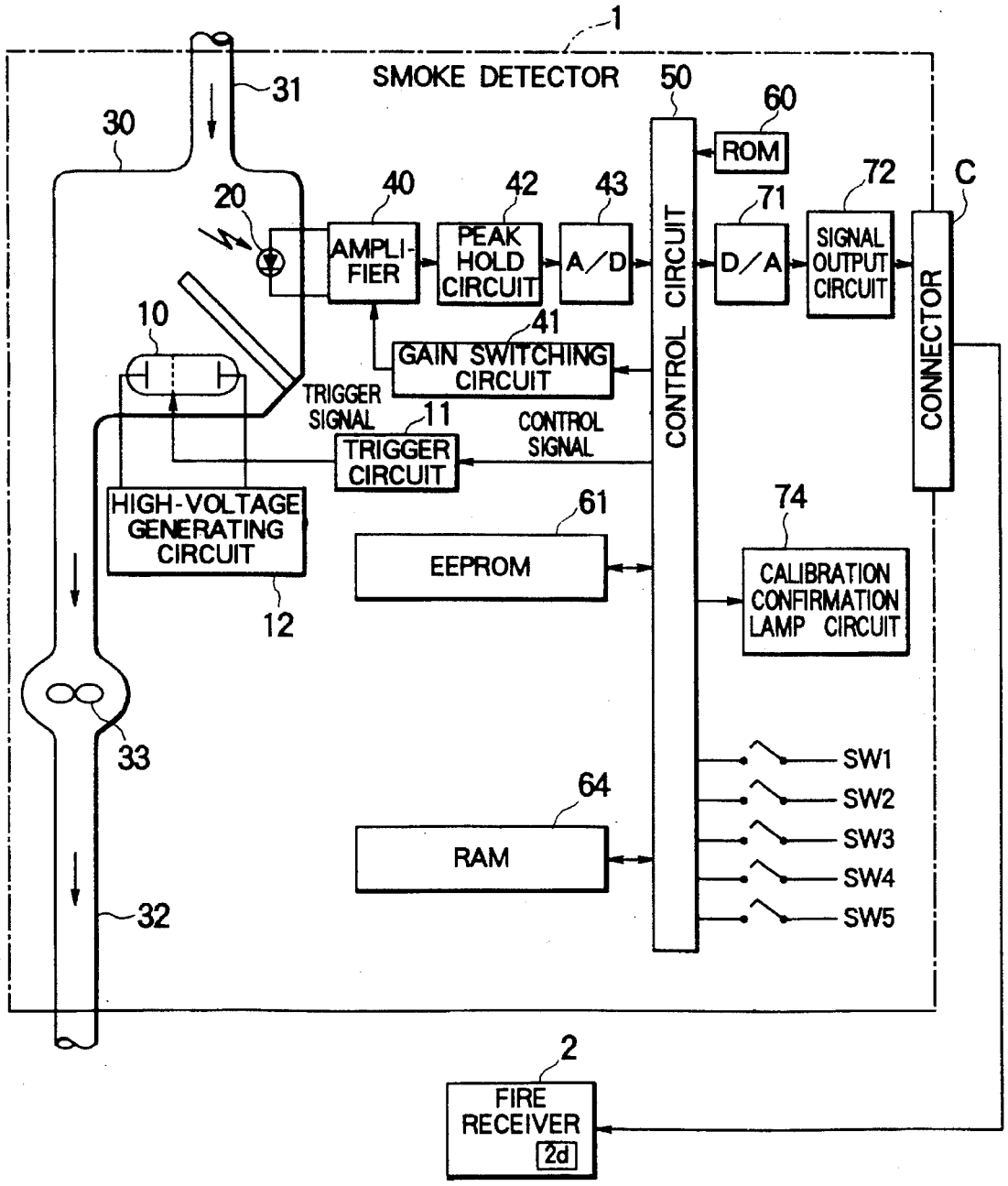
FIG. 1 is a block diagram showing a smoke detecting apparatus according to a first embodiment of the present invention.

FIG. 1 is a block diagram showing a smoke detecting apparatus according to a first embodiment of the present invention.

In a smoke detector 1 of this embodiment, a xenon lamp 10 and a light receiving element 20 are provided in a smoke chamber 30 in the state where the xenon lamp 10 and the light receiving element 20 are separated by a light shielding plate 34. The light emitted from the xenon lamp 10 is scattered by smoke in the smoke chamber 30 and then reaches the light receiving element 20.

A high voltage required for emission is supplied to the xenon lamp 10 from a high-voltage generating circuit 12, and the emission timing thereof is controlled by the trigger signal supplied from a trigger circuit 11. The trigger circuit 11 generates the trigger signal on the basis of the control signal supplied from a control circuit 50.

The smoke chamber 30 is connected to a sampling pipe 31 for introducing into the smoke chamber 30 an atmosphere where the smoke detector 1 is installed, and a pipe 32 for discharging the air in the smoke chamber 30 to the outside of the smoke detector 1. An aspiration fan 33 is provided in the pipe 32.

An amplifier 40 amplifies the output signal from the light receiving element 20, the gain of the amplifier 40 being controlled by a gain switching circuit 41. A peak holding circuit 42 holds the peak of the output signal from the amplifier 40, and an A/D converting circuit 43 converts the analog signal output from the peak holding circuit 42 into a digital signal.

The control circuit 50 comprises a microcomputer or the like for controlling the overall operation of the smoke detector 1 and determining the current smoke density in the smoke chamber 30 on the basis of the digital signal from the A/D converting circuit 43.

Figure 2:
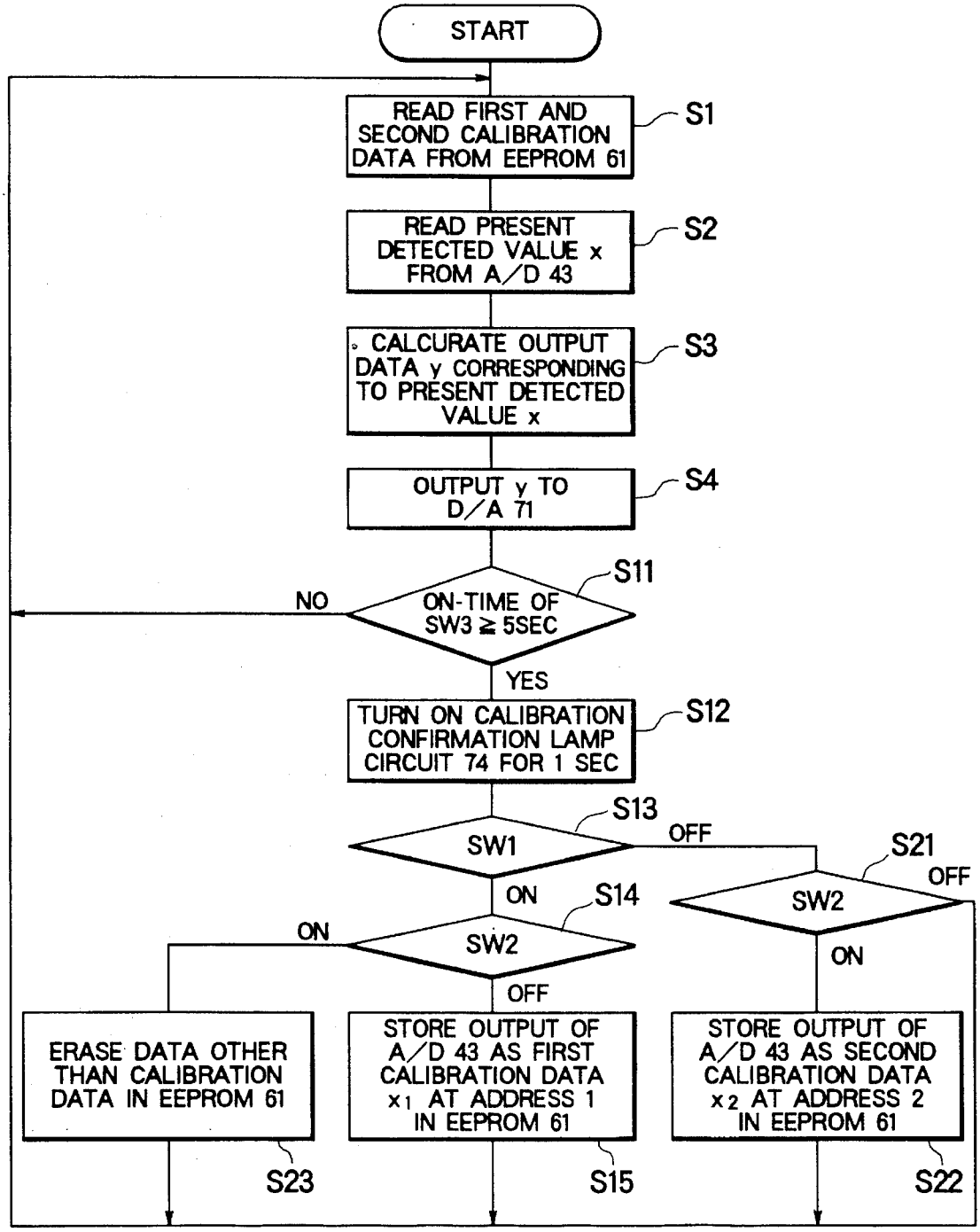
FIG. 2 is a flowchart showing the operation of the first embodiment.

A ROM (read only memory) 60 stores the program shown in the flowchart of FIG. 2. An EEPROM (electrically erasable and programmable ROM) 61 stores as first calibration data the output data from the A/D converting circuit 43 when pure oxygen gas (first reference gas) is sucked.into the smoke chamber 30, for example, at 1 atm and room temperature, and stores as second calibration data the output data from the A/D converting circuit 43 when pure freon 12 gas (second reference gas) is sucked into the smoke chamber 30. A RAM (randam access memory) 64 is a memory for operation with the control circuit 50.

Figures 4A, 4B, 4C:
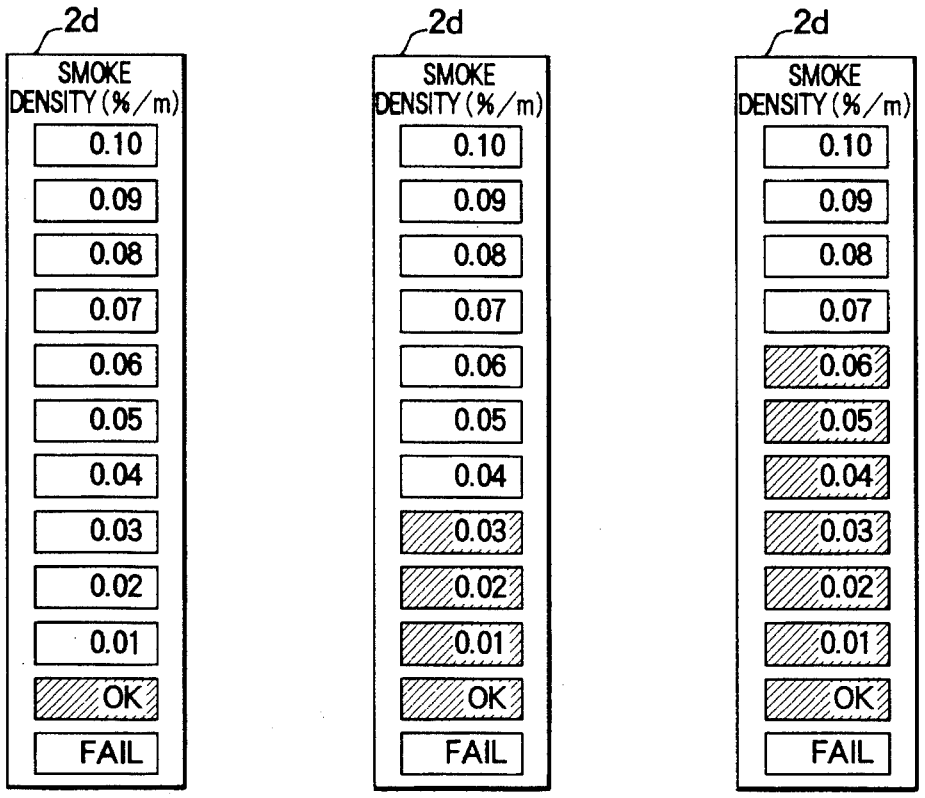
FIGS. 4A to 4C are drawings each showing a smoke density display device 2d provided on a receiver.

A D/A converting circuit 71 converts the digital signal output from the control circuit 50 into an analog signal for transmitting the signal to a fire receiver 2 through a signal output circuit 72 and a connector C. The receiver 2 is provided with a smoke density display device 2d for displaying a smoke density, as shown in FIGS. 4A to 4C.

A calibration confirmation lamp circuit 74 indicates that the sensitivity of the smoke detector I is being adjusted.

Switches SW1 and SW2 are lock-type switches which are operated according to the types of the gases used for calibrating the sensitivity of the smoke detector 1, and a switch SW3 is a nonlock-type switch which is turned on for 5 seconds or more when the sensitivity of the smoke detector 1 is calibrated.

The EEPROM 61 for storing a detected value of a memory calibration reference gas is an example of memory for storing the output data from the A/D converting circuit 43 as first calibration data when the smoke chamber 30 is filled with a first reference gas, and for storing the output data from the A/D converting circuit 43 as second calibration data when the smoke chamber 30 is filled with a second reference gas. The EEPROM 61 is an electrically rewritable non-volatile memory.

The control circuit 50 and the ROM 60 are examples of computing means for performing a predetermined calculation on the basis of the output data from the A/D converting circuit 43. The computing means computes output data required for displaying a proper smoke density corresponding to the output data from the A/D converting circuit 43 on the smoke density display device 2d of the fire receiver 2 on the basis of the first and second calibration data and the output data from the A/D converting circuit 43.

Figure 3:
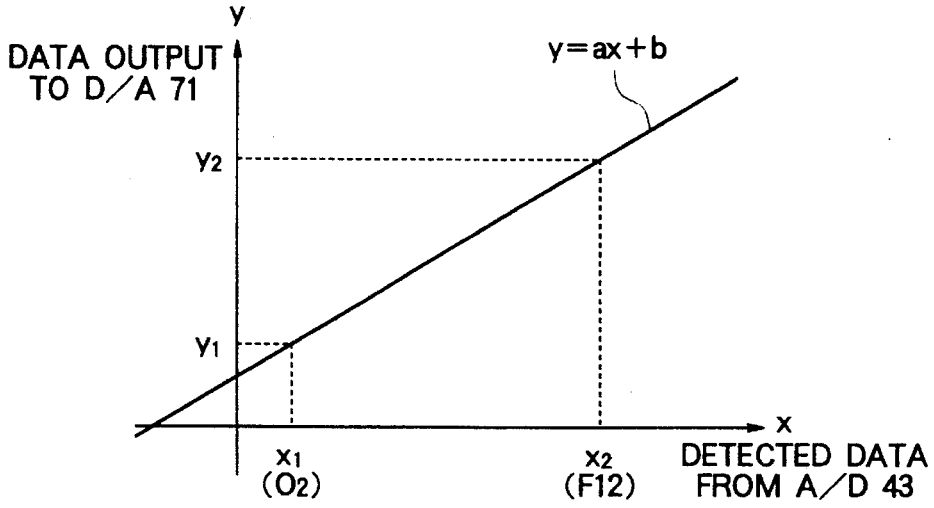
FIG. 3 is a graph showing the relationship between output data from an A/D converting circuit 43 and detected data input to a D/A converting circuit 71 in the first embodiment.

Specifically, assuming that the first calibration data is $x_1$, the second calibration data is $x_2$, the present output data from the A/D converting circuit 43 is x, the output data required for displaying a smoke density corresponding to a first gas on the smoke density display device 2d is $y_1$, the output data required for displaying a smoke density corresponding to a second gas on the smoke density display device 2d is $y_2$, and the output data required for displaying a proper density corresponding to the output data from the A/D converting circuit 43 on the smoke density display device 2d is y, as shown in FIG. 3, the computing means calculates the output data y by the following equation:

$$y=\{(y_2-y_1)/(x_2-x_1)\}\cdot x+(y_1\cdot x_2-y_2\cdot x_1)/(x_2-x_1)$$

The operation of the first embodiment is described below.

FIG. 2 is a flowchart showing the operation of the first embodiment. In the flowchart, Steps S11 to S23 indicate the preparatory operation for adjusting the sensitivity of the smoke detector 1, and Steps S1 to S4 indicate the smoke detecting operation including sensitivity adjustment.

The preparatory operation for adjusting the sensitivity is described below.

Before the sensitivity of the smoke detector 1 is adjusted, the switch SW1 is turned on, and the switch SW2 is turned off, while the smoke chamber 30 is filled with pure oxygen through the sample pipe 31 at 1 atm and room temperature. In this state, the sensitivity adjustment command switch SW3 is turned on for 5 seconds or more. When it is decided in Step S11 that the sensitivity adjustment command switch SW3 is turned on for 5 seconds or more, the confirmation lamp of the calibration confirmation lamp circuit 74 is turned on, in Step S12, for 1 second for indicating that the operation of adjusting the sensitivity is started. At this time, since the switch SW1 is turned on and the switch SW2 is turned off, the flow moves to Step S15 through Steps S13 and S14. In Step S15, in the state where the smoke chamber 30 is filled with pure oxygen, the output signal from the light receiving element 20 is amplified, and the peak value of the amplified signal is held by the peak holding circuit 42, and is converted into digital data by the A/D converting circuit 43. The converted output data is stored as first calibration data $x_1$ in the EEPROM 61. The smoke detecting operation (Steps S1 to S4) is then executed.

The pure oxygen gas is then discharged from the pipe 32 by the aspiration fan 33, and the smoke chamber 30 is filled with pure freon 12 through the sampling pipe 31 at 1 atm and room temperature. The switch SW1 is turned off, the switch SW2 is turned on, and the sensitivity adjustment command switch SW3 is turned on for 5 seconds or more. When it is decided in Step S11 that the sensitivity adjustment command switch SW3 is turned on for 5 seconds or more, the confirmation lamp of the calibration confirmation lamp circuit 74 is turned on, in Step S12, for 1 second for indicating that the sensitivity adjusting operation is started. Since the switch SW1 is turned off and the switch SW2 is turned on, the flow moves to Step S22 through Steps S13 and S21. In Step S22, in the state where the smoke chamber 30 is filled with the pure freon 12, the output signal from the light receiving element 20 is amplified by the amplifier circuit 40, and the peak value of the amplified signal is held by the peak holding circuit 42, and is converted into digital data by the A/D converting circuit 43. The converted output data is stored as the second calibration data $x_2$ in the EEPROM 61. The smoke detecting operation below (Steps S1 to S4) is then executed. If both switches SW1 and SW2 are turned on, the flow moves to Step S23 through Steps S13 and S14, and data other than the calibration data stored in the EEPROM 61 is erased in Step S23.

The smoke density detecting operation including the sensitivity adjustment, i.e., the smoke detecting operation, is described below.

After the preparatory operation for sensitivity adjustment is completed, the first and second calibration data $x_1$ and $x_2$ are read from the EEPROM 61 in Step S1, and the present detected data (present output data from the A/D converting circuit 43) x is read in Step S2. In Step S3, data y to be output to the D/A converting circuit 71 and required for displaying, on the smoke density display device **2*d*, a proper smoke density corresponding to the present output data x is calculated by the control device 50 using the ROM 60** on the basis of the first and second calibration data $x_1$ and $x_2$, the present detected data x, the output data $y_1$ corresponding to the data $x_1$ and the output data $y_2$ corresponding to the data $x_2$. Namely, the sensitivity is adjusted.

The output data $y_1$ is the data to be output to the D/A converting circuit 71 and required for displaying, on the smoke density display device **2*d* of the fire receiver 2, the smoke density (about 0.005 %/m) corresponding to oxygen gas used as the first reference gas. The output data $y_2$ is the data to be output to the D/A converting circuit 71 and required for displaying, on the smoke density display device 2*d* of the fire receiver 2, the smoke density (about 0.035 %/m) corresponding to freon 12 gas used as the second reference gas. Both output data $y_1$ and $y_2$ are previously calculated and stored in the ROM 60. Namely, since the density of the oxygen gas corresponds to a smoke density of about 0.005 %/m, only an "OK" portion of the smoke density display device 2*d* is lighted when oxygen gas is introduced into the smoke chamber 30, as shown in FIG. 4A. Since the density of the freon 12 gas corresponds to a smoke density of about 0.035 %/m, portions of "OK", "0.01", "0.02" and "0.03" in the smoke density display device 2*d* are lighted when the freon 12 gas is introduced into the smoke chamber 30**, as shown in FIG. 4B.

When the data y to be output to the D/A converting circuit 71 and required for displaying, on the smoke density display device **2*d*, a proper smoke density corresponding to the present output data x is computed by the control device 50 using the ROM 60, the relationship between x and y is generally expressed by the equation, y=ax+b, as shown in FIG. 3**. It is explained below that the equation y=ax+b is changed to the equation $$y=\{(y_2-y_1)/(x_2-x_1)\}\cdot x+((y_1\cdot x_2-y_2-x_1)/(x_2-x_1).$$

The following two equations are obtained from FIG. 3:

$$y_1=ax_1+b$$

$$y_2=ax_2+b$$

When simultaneous equations are solved on the basis of these equations, the following equations are obtained:

$$a=\{(y_2-y_1)/(x_2-x_1)\}$$

$$b=(y_1\cdot x_2-y_2\cdot x_1)/(x_2-x_1)$$

With the substitution of a and b in the equation y=ax+b, therefore, the following equation is obtained:

$$\begin{aligned} y &= ax+b \\ &= \{(y_2-y_1)/(x_2-x_1)\}\cdot x+ \\ &\quad (y_1\cdot x_2-y_2\cdot x_1)/(x_2-x_1). \end{aligned}$$

The thus-determined output data y is supplied to the D/A converting circuit 71 in Step S4. The D/A converting circuit 71 converts the output data y into an analog signal which is sent to the fire receiver 2 by the signal output circuit 72. A proper smoke density corresponding to the present output data x from the A/D converting circuit 43 is displayed on the smoke density display device **2*d***. For example, if the present smoke density is 0.06 %/m, portions "OK" and "0.01" to "0.06" are lighted, as shown in FIG. 4C.

As described above, in the first embodiment, since the control circuit 50 computes the output data required for displaying a proper smoke density on the basis of the first and second calibration data and the output data from the A/D converting circuit 43, the sensitivity can be adjusted by using the first and second reference gases only once.

Embodiment 2

In the first embodiment shown in FIG. 1, as first calibration data $x_1h$, the output data from the A/D converting circuit 43 can be used when the first reference gas is sucked in the smoke chamber 30 and when the output signal from the light receiving element 20 is amplified by the amplifier 40 with a gain Gh higher than the gain Gn at a set sensitivity. As second calibration data $x_2h$, the output data from the A/D converting circuit 43 can be used when the second reference gas is sucked in the smoke chamber 30 and when the output signal from the light receiving element 20 is amplified by the amplifier 40 with the gain Gh higher than the gain Gn at a set sensitivity.

These calibration data $x_1h$ and $x_2h$ are stored in the EEPROM 61.

In this second embodiment, on the basis of the first and second calibration data $x_1h$ and $x_2h$, the present output data x from the A/D converting circuit 43, the output data $y_1$ required for displaying a smoke density corresponding to the first gas on the smoke density display device 2d, the output data $y_2$ required for displaying a smoke density corresponding to the second gas on the smoke density display device 2d, the gain Gn at the set sensitivity and the gain Gh higher than the gain Gn, the control circuit 50 computes the output data y required for displaying a proper smoke density corresponding to the output data from the A/D converting circuit 43 on the smoke density display device 2d by the following equation:

$$y=[(y_2-y_1)/\{(x_2h-x_1h)\cdot(Gn/Gh)\}]\cdot x+(y_1\cdot x_2h-y_2\cdot x_1h)/(x_2h-x_1h)$$

Figure 5:
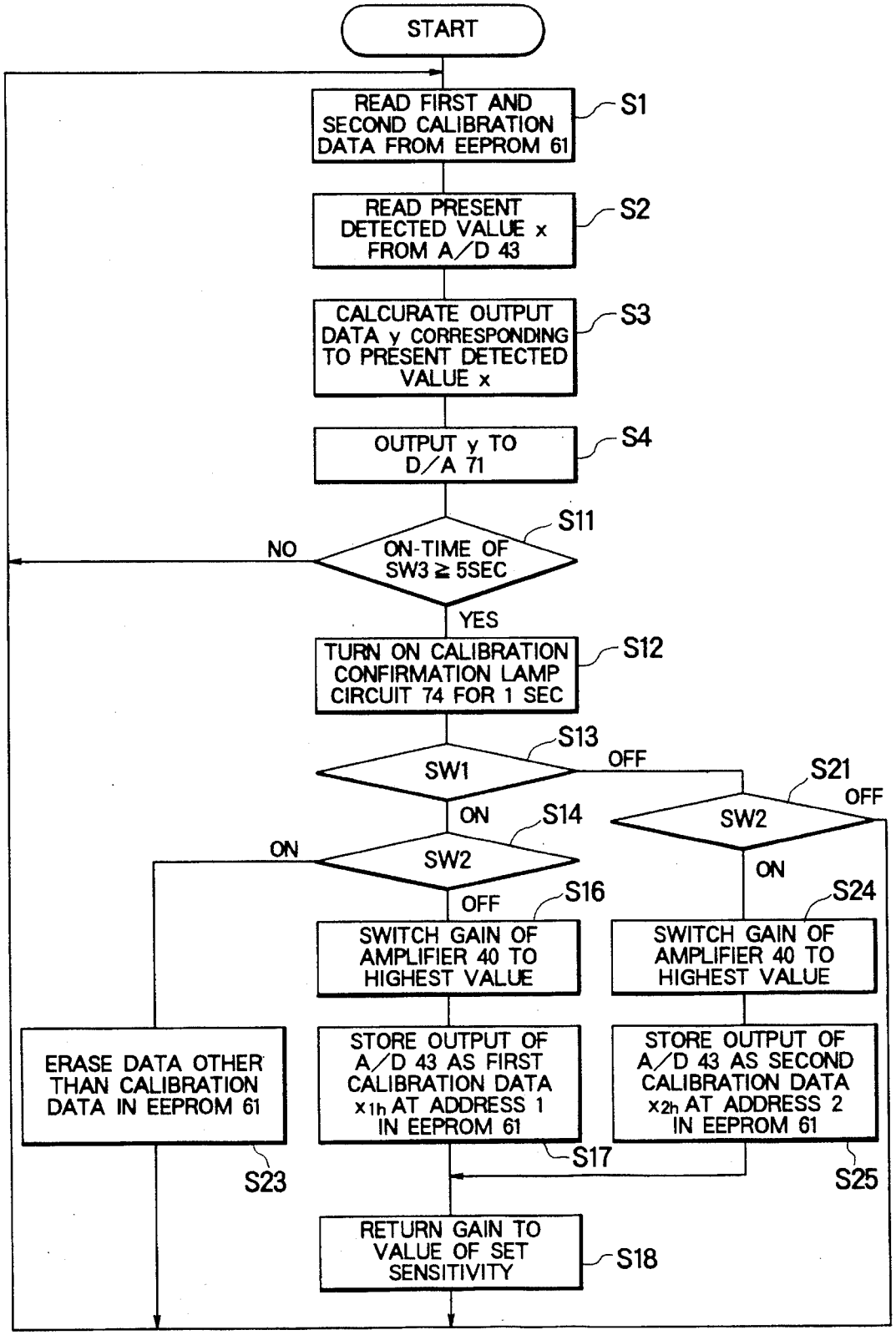
FIG. 5 is a flowchart showing the operation of a second embodiment.

The operation of the second embodiment is described below with reference to the flowchart shown in FIG. 5.

The preparatory operation for sensitivity adjustment is first described.

Before the adjustment of the sensitivity of the smoke detector 1 is executed, the switch SW1 is turned on and the switch SW2 is turned off while the smoke chamber 30 is filled with pure oxygen through the sample pipe 31, for example, at 1 atm and room temperature. In this state, the sensitivity adjustment command switch SW3 is turned on for 5 seconds or more. When it is decided in Step S11 that the sensitivity adjustment command switch SW3 is turned on for 5 seconds or more, the confirmation lamp of the calibration confirmation lamp circuit 74 is turned on, in Step S12, for 1 second for indicating that the sensitivity adjusting operation is started. Since the switch SW1 is turned on and the switch SW2 is turned off, the flow moves to Step S16 through Steps S13 and S14. In Step S16, the gain of the amplifier 40 is switched to the highest value by driving the gain switching circuit 41. In next Step S17, in the state where the smoke chamber 30 is filled with pure oxygen, the output signal from the light receiving element 20 is amplified, and the peak value of the amplified signal is held by the peak holding circuit 42, and is converted into digital data by the A/D converting circuit 43. The converted output data is stored as first calibration data $x_1h$ in the EEPROM 61. The gain of the amplifier 40 is then returned to the gain Gn at the set sensitivity in Step S18. The smoke detecting operation is then executed in Steps S1 to S4.

The pure oxygen gas is then discharged from the pipe 32, and the smoke chamber 30 is filled with pure freon 12 through the sampling pipe 31. The switch SW1 is turned off, the switch SW2 is turned on, and the sensitivity adjustment command switch SW3 is turned on for 5 seconds or more. When it is decided in Step S11 that the sensitivity adjustment command switch SW3 is turned on for 5 seconds or more, the confirmation lamp of the calibration confirmation lamp circuit 74 is turned on, in Step S12, for 1 second for indicating that the sensitivity adjusting operation is started in Step S12. Since the switch SW1 is turned off and the switch SW2 is turned on, the flow moves to Step S24 through the Steps S13 and S21. In Step S24, the gain of the amplifier 40 is switched to the highest value by driving the gain. switching circuit 41. In next Step S25, in the state where the smoke chamber 30 is filled with the pure freon 12 gas, the output signal from the light receiving element 20 is amplified by the amplifier 40, and the peak value of the amplified signal is held by the peak holding circuit 42, and is converted into digital data by the A/D converting circuit 43. The converted output data is stored as second calibration data $x_2h$ in the EEPROM 61. In Step S18, the gain of the amplifier 40 is returned to the gain Gn at the set sensitivity. The smoke detecting operation is then executed in Steps S1 to S4. If both switches SW1 and SW2 are turned on, data other than the calibration data in the data stored in the EEPROM 61 is erased in Step S23.

The smoke density detecting operation including sensitivity adjustment, i.e., the smoke detecting operation, is described below.

After the preparatory operation for sensitivity adjustment is completed, as described above, the first and second calibration data $x_1h$ and $x_2h$ are read from the EEPROM 61 in Step S1, and the present detected data (the present output data from the A/D converting circuit 43) x is read in Step S2. On the basis of the first and second calibration data $x_1h$ and $x_2h$, the present detected data x, and the output data $y_1$ and $y_2$ from the D/A converting circuit 71, the data y to be output to the D/A converting circuit 71 required for displaying a proper smoke density corresponding to the present output data x on the smoke density display device 2d is computed by the control circuit 50 using the ROM 60 in Step S3. Namely, the sensitivity is adjusted.

The data y to be output to the D/A converting circuit 71 required for displaying a proper smoke density corresponding to the present output data x on the smoke density display device 2d is computed by the control circuit 50 using the following equation:

$$y=[(y_2-y_1)/\{(x_2h-x_1h)\cdot(Gn/Gh)\}]\cdot x+(y_1\cdot x_2h-y_2\cdot x_1h)/(x_2h-x_1h)$$

Figure 6:
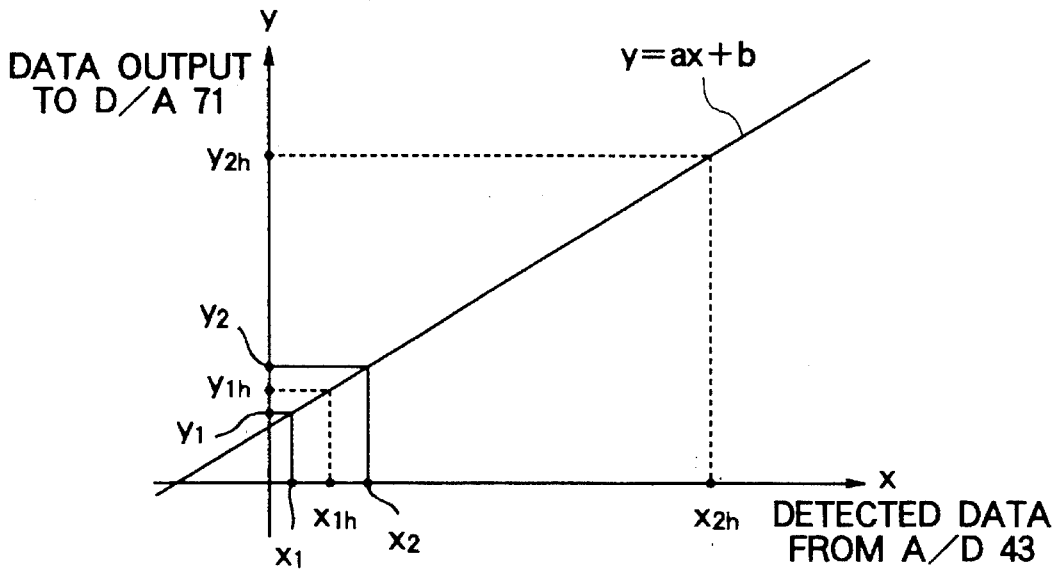
FIG. 6 is a graph showing the relationship between output data from an A/D converting circuit 43 and detected data input to a D/A converting circuit 71 in the second embodiment.
Figure 7:
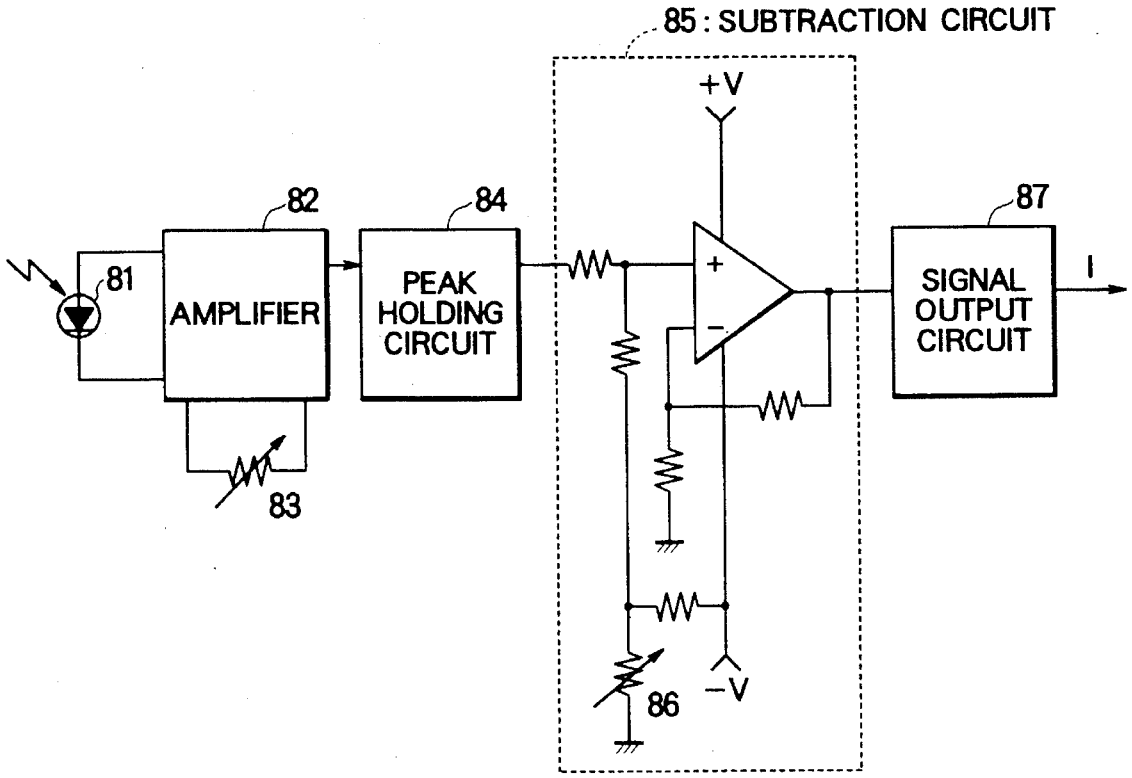
FIG. 7 is a drawing showing the circuit of a principal portion of a conventional smoke detector.
Figure 8:
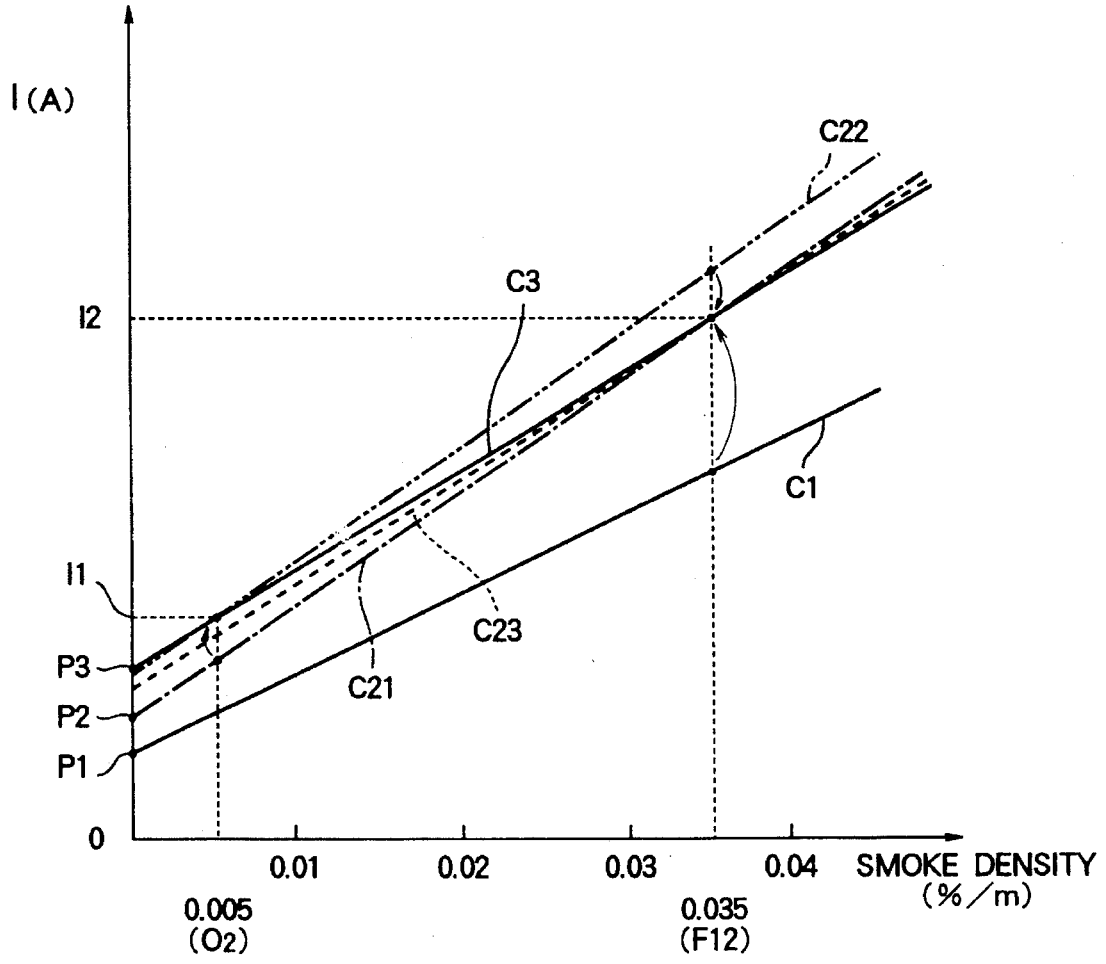
FIG. 8 is a drawing showing a method of adjusting the sensitivity of a conventional smoke detector.

The computation of the output data y using the above equation is described below with reference to FIG. 6. In FIG. 6, $x_1$ is the output value of the A/D converting circuit 43 when the smoke chamber 30 is filled with the first reference gas (oxygen) with the set gain Gn, and $x_2$ is the output value of the A/D converting circuit 43 when the smoke chamber 30 is filled with the second reference gas (freon 12) with the set gain Gn.

The following two equation are obtained from FIG. 6:

$$y_1=a\cdot x_1+b$$

$$y_2=a\cdot x_2+b$$

When simultaneous equations are solved on the basis of these equations, the following equations are obtained:

$$a=\{(y_2-y_1)/(x_2-x_1)\}$$

$$b=(y_1\cdot x_2-y_2\cdot x_1)/(x_2-x_1)$$

With the substitution of a and b in the equation y=ax+b, therefore, the following equation is obtained:

$$\begin{aligned} y &= a\cdot x+b \\ &= \{(y_2-y_1)/(x_2-x_1)\}\cdot x+ \\ &\quad (y_1\cdot x_2-y_2\cdot x_1)/(x_2-x_1). \end{aligned}$$

Since the first and second calibration data $x_1h$ and $x_2h$ are data amplified with the gain Gh higher than the gain Gn of the amplifier 40 at the set sensitivity, $$x_1=x_1h\cdot(Gn/Gh)$$

$$x_2=x_2h\cdot(Gn/Gh)$$

Therefore, the following equation is obtained:

$$y=[(y_2-y_1)/\{(x_2h-x_1h)\cdot(Gn/Gh)\}]\cdot x+(y_1\cdot x_2h-y_2\cdot x_1h)/(x_2h-x_1h)$$

The thus-determined output data y is supplied to the D/A converting circuit 71 in Step S4. The output data y is converted into an analog value by the D/A converting circuit 71, and is sent to the fire receiver 2 by the signal output circuit 72. A proper smoke density value corresponding to the present output data x from the A/D converting circuit 43 is displayed on the smoke density display device 2*d*.

In the second embodiment, since a proper smoke density is computed by using the data amplified with the gain Gh higher than the gain Gn of the amplifier 40 at the set sensitivity, the sensitivity can be adjusted with high precision in a region of smoke density values higher than the density of the gases used for obtaining the calibration data, for example, a smoke density of about 0.05 or 0.10 %/m.

Although, in the second embodiment, the gain of the amplifier 40 is switched to the highest value by driving the gain switching circuit 41 when the sensitivity characteristic is calibrated, data may be amplified with a gain Gh higher than the gain Gn at the set sensitivity in place of amplification with the highest gain.

Although, in the second embodiment, the data y to be output to the D/A converting circuit 71 corresponding to the present output data x is computed by using the data $x_1h$, $x_2h$, $y_1$, $y_2$ and Gn/Gh, the output data y can be computed by using the data $x_1h$, $x_2h$, $y_1h$ and $y_2h$ without using the data Gn/Gh. Namely, the output data y can be computed by the following equation:

$$y=\{(y_2h-y_1h)/(x_2h-x_1h)\}\cdot x+(y_1h\cdot x_2h-y_2h\cdot x_1h)/(x_2h),$$

wherein the data $x_1h$ is the output data from the A/D converting circuit 43 when the smoke chamber 30 is filled with the first reference gas and used as the first calibration data when the output signal from the light receiving element 20 is amplified with the gain higher than the gain at the set sensitivity, the data $x_2h$ is the output data from the A/D converting circuit 43 when the smoke chamber 30 is filled with the second reference gas and used as the second calibration data when the output signal from the light receiving element 20 is amplified with the gain higher than the gain at the set sensitivity, the data $y_1h$ is the output data from the signal output circuit 72 corresponding to the first calibration data $x_1h$, and the data $y_2h$ is the output data from the signal output circuit 72 corresponding to the second calibration data $x_2h$. The data $y_1h$ and $y_2h$ are previously calculated by the equations below using the output data $x_1$ from the A/D converting circuit 43 for the first reference gas when the amplifier 40 has the set sensitivity, the output data $x_2$ from the A/D converting circuit 43 for the second reference gas when the amplifier 40 has the set sensitivity, the output data $y_1$ from the signal output circuit 72 required for displaying a smoke density corresponding to the first reference gas on the smoke density display device 2d, and the output data $y_2$ from the signal output circuit 72 required for displaying a smoke density corresponding to the second reference gas on the smoke density display device 2*d*.

$$y_1h=\{(y_2-y_1)/(x_2-x_1)\}\cdot(Gh/Gn)\cdot x_1+(y_1\cdot x_2-y_2\cdot x_1)/(x_2-x_1)$$

$$y_2h=\{(y_2-y_1)/(x_2-x_1)\}\cdot(Gh/Gn)\cdot x_2+(y_1-x_2-y_2\cdot x_1)/(x_2-x_1)$$

Although, in each of the embodiments, oxygen gas and freon 12 gas are used as the reference gases, other pure gases may be used, and more than two kinds of pure gases may be used. Although, in the above embodiments, the xenon lamp is used, a light emitting lamp other than xenon lamp may be used.

Although, in each of the embodiments, the analog signal is sent to the fire receiver 2, a digital signal such as a pulse code or the like may be sent to the fire receiver 2. Although, in the embodiments, memory such as the EEPROM 61 for storing the first and second calibration data and the computing means are provided on the side of the smoke detector 1, one or both of the devices may be provided on the side of the fire receiver 2 or a transmitter (not shown).

In addition, although, in each of the embodiments, the smoke density display device 2*d* is provided on the side of the fire receiver 2, the display device may be provided on the smoke detector 1.

What is claimed is:

1. A smoke detecting apparatus for fire alarm comprising:

a smoke chamber into which smoke to be detected is introduced;

a light emitting lamp disposed in said smoke chamber;

a light receiving element disposed in said smoke chamber so as to receive the light emitted from said light emitting lamp;

an A/D converting circuit for converting the output signal from said light receiving element into a digital signal;

a memory for storing data therein;

computing means for storing in said memory, as first calibration data, the output data from said A/D converting circuit when said smoke chamber is filled with a first reference gas, storing in said memory, as second calibration data, the output data from said A/D converting circuit when said smoke chamber is filled with a second reference gas, and computing a proper smoke density corresponding to the output data from said A/D converting circuit on the basis of the first and second calibration data and the output data from said A/D converting circuit; and display means for displaying the smoke density computed by said computing means.

2. An apparatus according to claim 1, further comprising a D/A converting circuit for converting the output data from said computing means into an analog signal, and a signal output circuit for outputting the output signal from said D/A converting circuit to said display means.

3. An apparatus according to claim 2, wherein said computing means computes data y to be output to said D/A converting circuit using the first and second calibration data $x_1$ and $x_2$, the output data x from said A/D converting circuit, output data $y_1$ required for displaying on said display means a smoke density corresponding to said first reference gas, and output data $y_2$ required for displaying on said display means a smoke density corresponding to said second reference gas on the basis of the following equation:

$$y=\{(y_2-y_1)/(x_2-x_1)\}\cdot x+((y_1\cdot x_2-y_2\cdot x_1)/(x_2-x_1).$$

4. An apparatus according to claim 3, wherein said memory previously stores the output data $y_1$ required for displaying on said display means a smoke density corresponding to said first reference gas, and the output data $y_2$ required for displaying on said display means a smoke density corresponding to said second reference gas.

5. An apparatus according to claim 2, further comprising an amplifier for amplifying the output signal from said light receiving element to output the amplified signal to said A/D converting circuit, and a gain switching circuit for switching the gain of said amplifier.

6. An apparatus according to claim 5, wherein said computing means stores in said memory, as first calibration data, the output data from said A/D converting circuit when said smoke chamber is filled with said first reference gas and when the gain of said amplifier is switched to a gain Gh higher than the set gain Gn by said gain switching circuit, and as second calibration data, the output data from said A/D converting circuit when said smoke chamber is filled with said second reference gas and when the gain of said amplifier is switched to a gain Gh higher than the set gain Gn by said gain switching circuit.

7. An apparatus according to claim 6, wherein said computing means computes the data y to be output to said D/A converting circuit using the first and second calibration data $x_1h$ and $x_2h$, the output data x from said A/D converting circuit when said amplifier has the set gain Gn, output data $y_1$ required for displaying on said display means a smoke density corresponding to said first reference gas, and output data $y_2$ required for displaying on said display means a smoke density corresponding to said second reference gas on the basis of the following equation:

$$y=[(y_2-y_1)/\{(x_2h-x_1h)\cdot(Gn/Gh)\}]\cdot x+(y_1\cdot x_2h-y_2\cdot x_1h)/(x_2h-x_1h).$$

8. An apparatus according to claim 6, wherein said memory previously stores the output data $y_1$ required for displaying on said display means a smoke density corresponding to said first reference gas, and output data $y_2$ required for displaying on said display means a smoke density corresponding to said second reference gas.

9. An apparatus according to claim 8, wherein said memory previously stores first output data $y_1h$ of said signal output circuit corresponding to said first calibration data $x_1h$ and second output data $y_2h$ of said signal output circuit corresponding to said second calibration data $x_2h$, said computing means computing data y to be output to said D/A converting circuit on the basis of said first and second calibration data $x_1h$ and $x_2h$, and said first and second output data $y_1h$ and $y_2h$.

10. An apparatus according to claim 9, wherein said computing means computes said first and second output data $y_1h$ and $y_2h$ using said first and second calibration data $x_1$ and $x_2$ when said amplifier has the set gain Gn, said first and second calibration data $x_1h$ and $x_2h$ when said amplifier has the higher gain Gh, and said output data $y_1$ and $y_2$ stored in said memory on the basis of the equation below, and stores said output data $y_1h$ and $y_2h$ in said memory.

$$y_1h=\{(y_2-y_1)/(x_2-x_1)\}\cdot(Gh/Gn)\cdot x_1+(y_1\cdot x_2-y_2\cdot x_1)/(x_2-x_1)$$

$$y_22\ h=\{(y_2-y_1)/(x_2-x_1)\}\cdot(Gh/Gn)\cdot x_2+(y_1\cdot x_2-y_2\cdot x_1)/(x_2-x_1).$$

11. An apparatus according to claim 10, wherein said computing means computes the data y to be output to said D/A converting circuit using said first and second calibration data $x_1h$ and $x_2h$, said first and second output data $Y_1h$ and $y_2h$, and said output data x from said A/D converting circuit when said amplifier has the set gain Gn on the basis of the following equation:

$$y=\{(y_2h-y_1h)/(x_2h-x_1h)\}\cdot x+(y_1h\cdot x_2h-y_2h\cdot x_1h)/(x_2h-x_1h).$$

* * * * *